US007147223B2

(12) United States Patent
Fukuchi

(10) Patent No.: US 7,147,223 B2
(45) Date of Patent: Dec. 12, 2006

(54) SHEET CONVEYING DEVICE AND IMAGE FORMING APPARATUS INCLUDING THE SHEET CONVEYING DEVICE

(75) Inventor: Yutaka Fukuchi, Yokohama (JP)

(73) Assignee: Ricoh Company, Ltd., Tokyo (JP)

( * ) Notice: Subject to any disclaimer, the term of this patent is extended or adjusted under 35 U.S.C. 154(b) by 226 days.

(21) Appl. No.: 10/417,169

(22) Filed: Apr. 17, 2003

(65) Prior Publication Data

US 2004/0000753 A1 Jan. 1, 2004

(30) Foreign Application Priority Data

Apr. 17, 2002 (JP) ..... 2002-114530
Aug. 9, 2002 (JP) ..... 2002-232575

(51) Int. Cl.
*B65H 5/02* (2006.01)

(52) U.S. Cl. ..... 271/274

(58) Field of Classification Search ..... 271/272–274, 271/314, 125; 198/624; 411/398, 399, 400, 411/401; 267/158, 160, 163
See application file for complete search history.

(56) References Cited

U.S. PATENT DOCUMENTS 3,942,789 A * 3/1976 Townsend ..... 271/274
3,947,022 A * 3/1976 Kockler ..... 271/250
4,061,332 A * 12/1977 Baumgartel et al. ..... 271/270
4,188,025 A * 2/1980 Gusfafson et al. ..... 271/314
4,555,104 A * 11/1985 Fukuju et al. ..... 271/228
4,605,218 A * 8/1986 Knepper et al. ..... 271/238
4,611,802 A * 9/1986 Pedersen ..... 271/274
4,763,575 A * 8/1988 Miciukiewicz ..... 101/91
4,775,142 A * 10/1988 Silverberg ..... 271/251
4,997,179 A * 3/1991 Mizutani et al. ..... 271/306
5,031,895 A * 7/1991 Couper ..... 271/251
5,040,025 A 8/1991 Fukuchi
5,052,336 A 10/1991 Fukuchi
5,055,881 A 10/1991 Fukuchi
5,124,759 A 6/1992 Fukuchi et al.
5,172,900 A * 12/1992 Uno et al. ..... 271/125
5,199,702 A * 4/1993 Davis et al. ..... 271/274
5,269,509 A * 12/1993 Cromar et al. ..... 271/272
5,300,996 A 4/1994 Yokoyama et al.
5,329,340 A 7/1994 Fukuchi et al.
5,465,954 A * 11/1995 Takemoto et al. ..... 271/251
5,600,426 A * 2/1997 Gramlich et al. ..... 399/381
5,601,283 A * 2/1997 Pinckney ..... 271/228

(Continued)

FOREIGN PATENT DOCUMENTS

EP 0 363 807 4/1990

(Continued)

OTHER PUBLICATIONS

Patent Abstracts of Japan, 06-330971, Nov. 29, 1994.

*Primary Examiner*—Patrick Mackey
*Assistant Examiner*—Matthew J. Kohner
(74) *Attorney, Agent, or Firm*—Oblon, Spivak, McClelland, Maier & Neustadt, P.C.

(57) ABSTRACT

A sheet conveying device includes a drive roller having a shaft, a driven roller having a shaft, a biasing member that rotatably supports one of the drive roller and the driven roller and biases one of the drive roller and the driven roller against the other one of the drive roller and the driven roller, and a holding member that pivotally holds the biasing member. The sheet conveying device conveys a sheet while rotating the drive roller and the driven roller and passing the sheet through a nip part formed between the drive roller and the driven roller.

16 Claims, 6 Drawing Sheets

U.S. PATENT DOCUMENTS

| | | | | | |
|---|---|---|---|---|---|
| 5,653,439 | A | * | 8/1997 | Rider et al. | 271/274 |
| 5,689,764 | A | | 11/1997 | Fukuchi et al. | |
| 5,800,076 | A | * | 9/1998 | Umeda | 400/645.3 |
| 5,842,691 | A | * | 12/1998 | Nakamura | 271/122 |
| RE36,124 | E | | 3/1999 | Yokoyama et al. | |
| 5,988,635 | A | * | 11/1999 | Ohshima | 271/274 |
| 6,000,693 | A | * | 12/1999 | Tanquilla | 271/263 |
| 6,019,366 | A | * | 2/2000 | Tranquilla | 271/274 |
| 6,053,494 | A | * | 4/2000 | Baskette et al. | 271/251 |
| 6,128,451 | A | | 10/2000 | Fukuchi | |
| 6,181,899 | B1 | | 1/2001 | Fukuchi | |
| 6,308,027 | B1 | | 10/2001 | Obu et al. | |
| 6,308,949 | B1 | * | 10/2001 | Ito et al. | 271/251 |
| 6,378,858 | B1 | * | 4/2002 | Suga | 271/10.01 |
| 6,385,418 | B1 | | 5/2002 | Fukuchi | |
| 6,494,451 | B1 | * | 12/2002 | Michel | 271/274 |
| 6,542,707 | B1 | | 4/2003 | Muramatsu et al. | |
| 6,576,177 | B1 | | 6/2003 | Fukuchi | |
| 6,595,512 | B1 | * | 7/2003 | de Koning et al. | 271/125 |
| 6,619,658 | B1 | * | 9/2003 | Shiau | 271/274 |
| 6,857,631 | B1 | * | 2/2005 | Morrison et al. | 271/274 |
| 2004/0251619 | A1 | * | 12/2004 | Goto | 271/274 |

FOREIGN PATENT DOCUMENTS

| | | | | |
|---|---|---|---|---|
| EP | 0 895 955 | | | 2/1999 |
| JP | 53030392 | A | * | 3/1978 |
| JP | 60178146 | A | * | 9/1985 |
| JP | 63272734 | A | * | 11/1988 |
| JP | 01150651 | A | * | 6/1989 |
| JP | 02117537 | A | * | 5/1990 |
| JP | 02243438 | A | * | 9/1990 |
| JP | 06016274 | A | * | 1/1994 |
| JP | 06064774 | A | * | 3/1994 |
| JP | 08-034535 | | | 2/1996 |
| JP | 8-245011 | | | 9/1996 |
| JP | 63-066583 | | | 6/1997 |
| JP | 2619366 | | | 6/1997 |
| JP | 09-188449 | | | 7/1997 |
| JP | 11-199087 | | | 7/1999 |
| JP | 2001-19209 | | | 1/2001 |
| JP | 2002-316740 | | | 10/2002 |

* cited by examiner

SHEET CONVEYING DEVICE AND IMAGE FORMING APPARATUS INCLUDING THE SHEET CONVEYING DEVICE

CROSS-REFERENCE TO RELATED APPLICATIONS

The present application claims priority to Japanese Patent Application No. 2002-114530 filed in the Japanese Patent Office on Apr. 17, 2002 and Japanese Patent Application No. 2002-232575 filed in the Japanese Patent Office on Aug. 9, 2002, the disclosures of which are incorporated herein by reference.

BACKGROUND OF THE INVENTION

1. Field of the Invention

The present invention relates to a sheet conveying device for use in an image forming apparatus such as a copying machine, a printer, a facsimile machine, a multi-functional image forming apparatus, or other similar image forming apparatuses.

2. Discussion of the Background

A background sheet conveying device, which conveys a sheet in a predetermined direction while pinching the sheet between a drive roller and a driven roller which is press-contacted against the drive roller, has been proposed. With regard to a roller support mechanism that press-contacts the driven roller against the drive roller in the above-described background sheet conveying device, for example, Japanese Laid-open patent publication No. 63-66583 describes a roller support mechanism that uses a plate spring functioning as a roller support member. The plate spring rotatably supports a driven roller and exerts a bias force on the driven roller to be press-contacted against a drive roller. Japanese Laid-open patent publication No. 9-188449 also describes a roller support mechanism that uses a plate spring to bias a driven roller against a drive roller.

FIG. 1 is a perspective view of a background sheet conveying device including a roller support mechanism using a plate spring. In the background sheet conveying device of FIG. 1, a pair of sheet conveying rollers 123 include a drive roller 130 (illustrated by dotted lines) and a driven roller 131. A plate spring 132 rotatably supports the driven roller 131. Specifically, the driven roller 131 is supported by a pair of support arms 134 which are provided on one end part 132*b* of the plate spring 132. Two through holes 138 are formed in the middle part of the plate spring 132 at a predetermined distance apart. The background sheet conveying device of FIG. 1 further includes a guide plate 109. The guide plate 109 includes a support hole 136 and two protrusions 137 on the surface of the guide plate 109 at a predetermined distance apart. The plate spring 132 is fixed to the guide plate 109 by inserting the other end part 132*a* and a stepped bent part 133 of the plate spring 132 into the support hole 136 and by engaging the two protrusions 137 that are provided on the guide plate 109 in the two through holes 138 in the plate spring 132.

FIG. 2 is a perspective view of another background sheet conveying device including a roller support mechanism using a plate spring. In the background sheet conveying device of FIG. 2, a plate spring 102 rotatably supports a driven roller 101 on one end part 102*a* of the plate spring 102 and biases the driven roller 101 against a drive roller 103. The plate spring 102 is fixed to a plate-shaped holding member (not shown) that holds the plate spring 102 by press-fitting a protrusion 104*a* that is provided on the holding member into a hole (not shown) that is formed at the other end part 102*b* of the plate spring 102.

FIG. 3 is a perspective view of the background sheet conveying device of FIG. 2 according to an alternative example. In the background sheet conveying device of FIG. 3, the plate spring 102 is fixed to a plate-shaped holding member (not shown) that holds the plate spring 102 by securing the other end part 102*b* of the plate spring 102 to the holding member by a screw 105.

In the background sheet conveying device of FIG. 1, when the plate spring 132 is attached to the guide plate 109, the position of the driven roller 131 relative to the drive roller 130 is regulated by the two protrusions 137. However, because the distance between the two protrusions 137 is relatively small, it may be difficult to insure the accuracy of the position of the driven roller 131 relative to the drive roller 130.

Further, as described above, in the background sheet conveying device of FIGS. 2 and 3, the plate spring 102 is fixed to the plate-shaped holding member by press-fitting the protrusion 104*a* on the holding member into the hole of the plate spring 102 by use of a jig (not shown), and by securing the other end part 102*b* of the plate spring 102 to the holding member by the screw 105. In these background sheet conveying devices, it may be difficult to control the accuracy of the position of the driven roller 101 relative to the drive roller 103 and to control the pressure of fixing the plate spring 102 to the holding member. Further, in the case of fixing the plate spring 102 to the holding member by the screw 105, the plate spring 102 may be bent around the screw 105 due to torque.

In the above-described sheet conveying devices, when a driven roller is not in proper alignment with a drive roller, specifically, when the shaft of the driven roller is not in parallel with the shaft of the drive roller, a sheet may be skewed in a sheet conveying path.

SUMMARY OF THE INVENTION

Accordingly, an object of the present invention is to provide a sheet conveying device in which the accuracy of the position of a driven roller relative to a drive roller, specifically, parallelism of the driven roller and the drive roller, is increased and which prevents a sheet from being skewed, and to provide an image forming apparatus including the sheet conveying device.

According to one aspect of the present invention, a sheet conveying device includes a drive roller including a shaft, a driven roller including a shaft, a biasing member configured to rotatably support one of the drive roller and the driven roller and to bias one of the drive roller and the driven roller against the other one of the drive roller and the driven roller, and a holding member configured to pivotally hold the biasing member. The sheet conveying device conveys a sheet while rotating the drive roller and the driven roller and passing the sheet through a nip part formed between the drive roller and the driven roller.

According to another aspect of the present invention, an image forming apparatus includes an image carrier configured to carry an image, and the above-described sheet conveying device configured to convey a sheet that receives the image on at least one side of the sheet.

BRIEF DESCRIPTION OF THE DRAWINGS

A more complete appreciation of the present invention and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENTS

Figure 1:
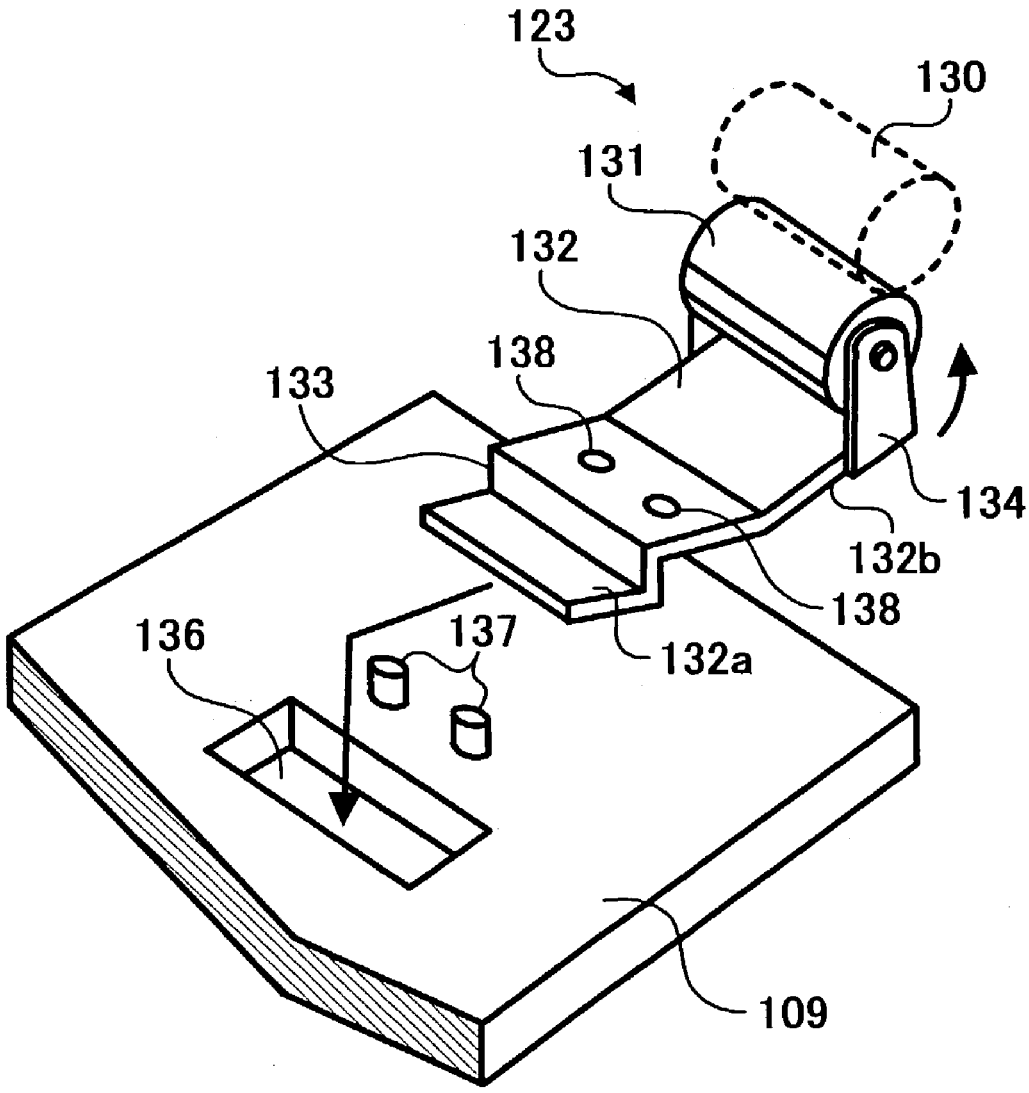
FIG. 1 BACKGROUND ART
FIG. 1 is a perspective view of a background sheet conveying device including a roller support mechanism.
Figure 2:
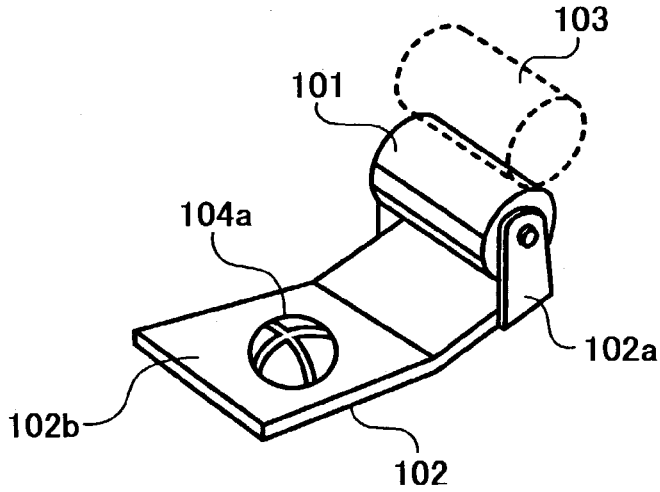
FIG. 2 BACKGROUND ART
FIG. 2 is a perspective view of another background sheet conveying device including a roller support mechanism.
Figure 3:
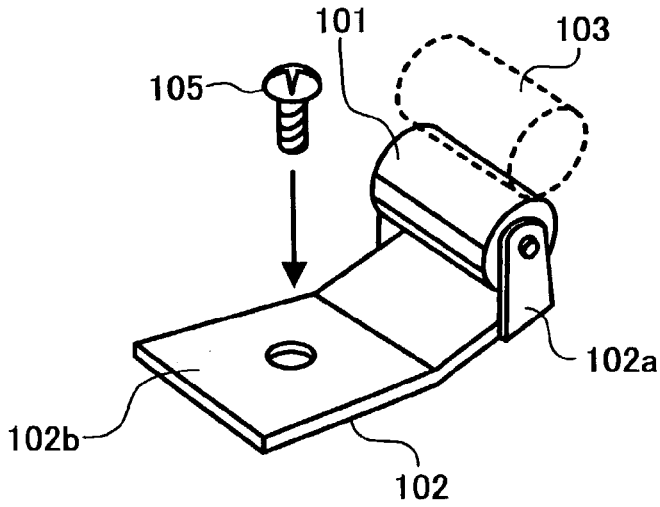
FIG. 3 BACKGROUND ART
FIG. 3 is a perspective view of the background sheet conveying device of FIG. 2 according to an alternative example.

Preferred embodiments of the present invention are described in detail referring to the drawings, wherein like reference numerals designate identical or corresponding parts throughout the several views.

Figure 4:
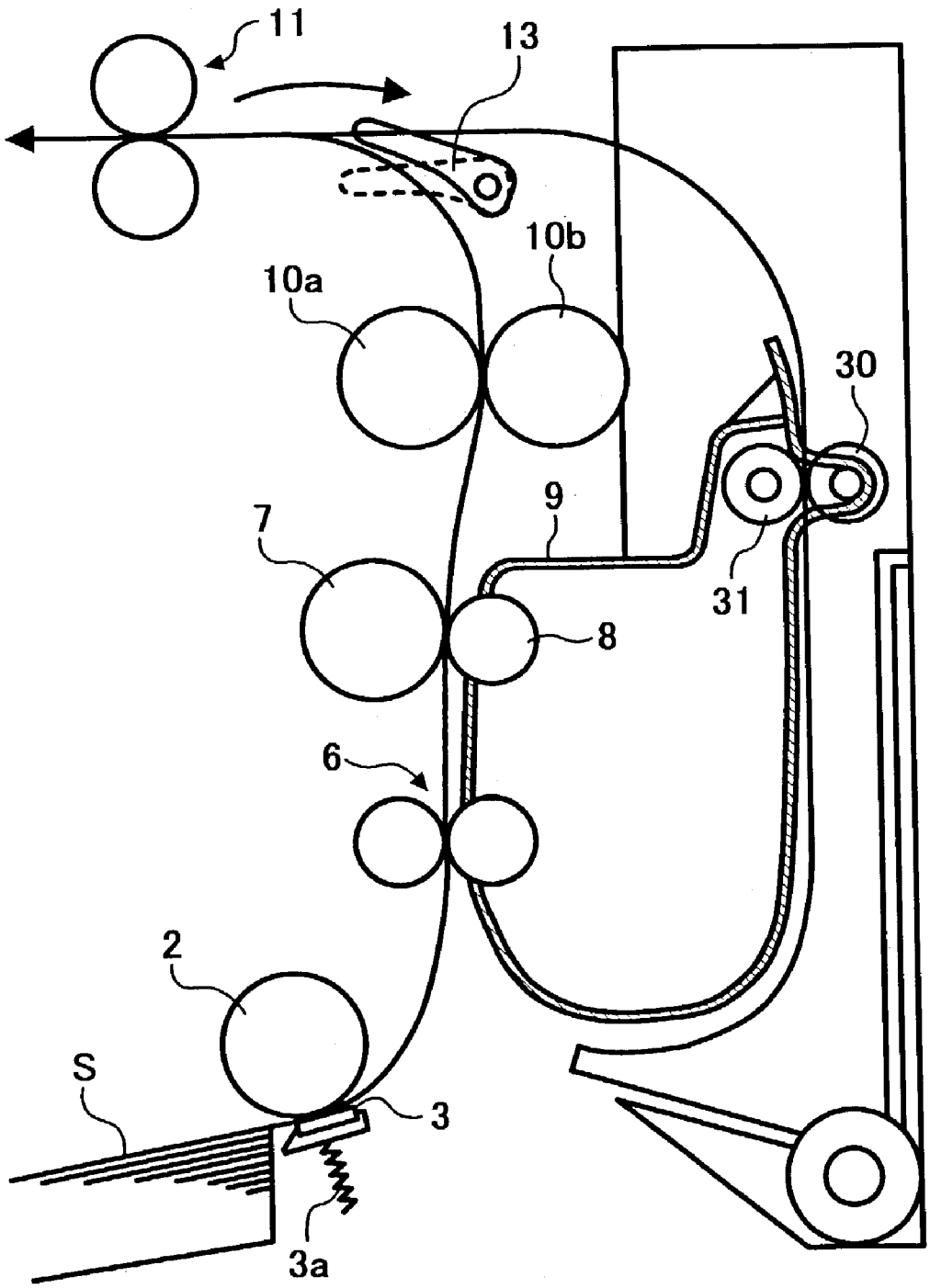
FIG. 4 is a schematic view of a cross section of a main part of an image forming apparatus including a sheet conveying device according to an embodiment of the present invention.

FIG. 4 is a schematic view of a cross section of a main part of an image forming apparatus including a sheet conveying device according to an embodiment of the present invention. A reference character (S) designates a sheet that is pressed against a sheet feeding roller 2 by a sheet raising mechanism (not shown). A sheet separation pad 3 is provided opposite to the sheet feeding roller 2 and is biased against the sheet feeding roller 2 by a compression spring 3*a*. The sheet feeding roller 2 is driven to rotate in accordance with a sheet feeding signal, thereby separating a top sheet from the stack of sheets (S) and feeding the top sheet toward a pair of registration rollers 6.

The sheet feeding roller 2 continues to rotate for a predetermined period of time after the sheet (S) reaches the registration rollers 6, and then stops rotating. By this rotation of the sheet feeding roller 2, the sheet (S) becomes bent between the registration rollers 6 and the sheet feeding roller 2. Subsequently, the registration rollers 6 start rotating, thereby conveying the sheet (S). The sheet (S) is guided by a guide plate 9 toward a nip part formed between a photoreceptor 7 and a transfer roller 8. A toner image that has been formed on the photoreceptor 7 is transferred onto the sheet (S) at the nip part between the photoreceptor 7 and the transfer roller 8. The photoreceptor 7 functions as an image carrier that carries a toner image on the surface thereof. Subsequently, the toner image is fixed onto the sheet (S) while the sheet (S) passes through a nip part formed between a fixing roller 10*a* and a pressure roller 10*b*. The sheet (S) having a fixed toner image thereon is directed toward a pair of sheet discharging rollers 11 by a pivotable separation pick 13 that is located in the position illustrated by solid lines in FIG. 4.

The sheet discharging rollers 11 are configured to be rotated in both forward and reverse directions. When forming an image on one side of the sheet (S), the sheet (S) is discharged from the image forming apparatus by the sheet discharging rollers 11 that rotates in the forward direction. When forming images on both sides of the sheet (S), after the trailing edge of the sheet (S) passes the separation pick 13, the separation pick 13 moves to the position illustrated by a dotted line in FIG. 4, and the sheet discharging rollers 11 start to rotate in the reverse direction. By the reverse rotations of the sheet discharging rollers 11, the sheet (S) is conveyed to a sheet conveying device including a drive roller 30 and a driven roller 31 that is press-contacted against the drive roller 30. The sheet conveying device conveys the sheet (S) toward the registration rollers 6 while passing the sheet (S) through the nip part formed between the drive roller 30 and the driven roller 31 and while guiding the sheet (S) by the guide plate 9. Subsequently, the registration rollers 6 feed the sheet (S) to the nip part between the photoreceptor 7 and the transfer roller 8. The toner image that has been formed on the photoreceptor 7 is transferred onto the rear side of the sheet (S) at the nip part between the photoreceptor 7 and the transfer roller 8.

Figure 5:
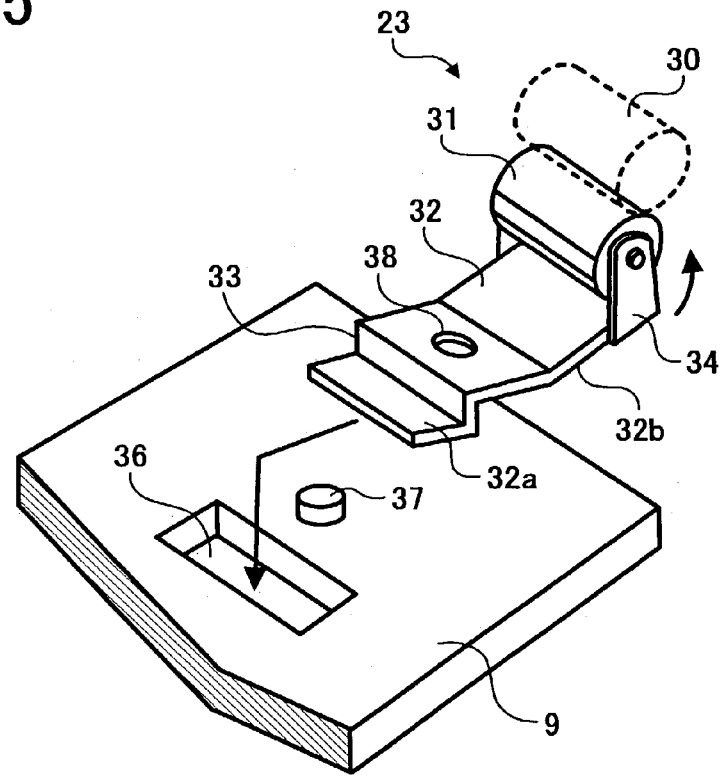
FIG. 5 is a perspective view of a sheet conveying device according to an embodiment of the present invention.

FIG. 5 is a perspective view of a sheet conveying device in the image forming apparatus of FIG. 4 according to an embodiment of the present invention. The sheet conveying device of FIG. 5 includes a pair of sheet conveying rollers 23 having the drive roller 30 and the driven roller 31 that is press-contacted against the driven roller 31, a plate spring 32, for example, formed from a spring steel serving as a biasing member that rotatably supports the driven roller 31 and biases the driven roller 31 against the drive roller 30. The guide plate 9 serves as a holding member that pivotally holds the plate spring 32. The driven roller 31 is rotatably supported by a pair of support arms 34 provided on one end part 32*b* of the plate spring 32. Specifically, the shaft (not shown) of the driven roller 31 is rotatably supported by the pair of support arms 34 while passing the shaft of the driven roller 31 through holes (not shown) formed in the support arms 34.

The plate spring 32 includes a through hole 38 formed at a center part of the plate spring 32 in the longitudinal direction of the plate spring 32. Further, the other end part 32*a* of the plate spring 32 is folded in an L shape in cross section. A reference numeral 33 indicates a stepped folded portion of the plate spring 32. A support hole 36 is formed in the guide plate 9 at an appropriate position, and a protrusion 37 is provided on the guide plate 9 in the vicinity of the support hole 36. The protrusion 37 is molded integral with the guide plate 9. Alternatively, the protrusion 37 as a separate member may be attached onto the surface of the guide plate 9.

When attaching the plate spring 32 to the guide plate 9, the other end part 32*a* and the stepped folded portion 33 of the plate spring 32 are inserted into the support hole 36 in the guide plate 9. Further, the protrusion 37 on the guide plate 9 is press-fitted into the through hole 38 in the plate spring 32. By attaching the plate spring 32 to the guide plate 9 as above, the plate spring 32 is held by the guide plate 9.

Figure 6:
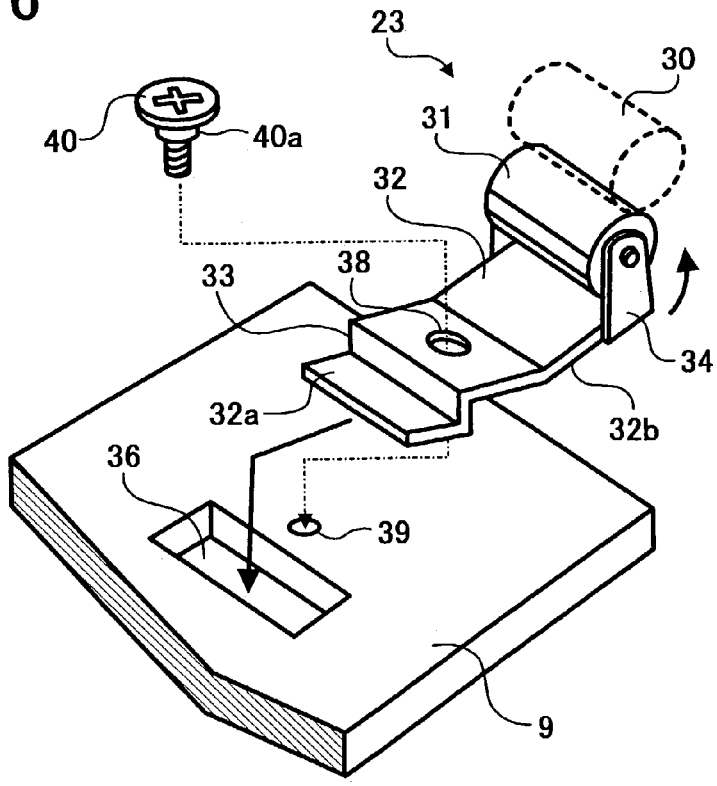
FIG. 6 is a perspective view of a sheet conveying device according to another embodiment of the present invention.

FIG. 6 is a perspective view of a sheet conveying device according to another embodiment of the present invention. The construction of the sheet conveying device of FIG. 6 is similar to that of the sheet conveying device of FIG. 5 with the exception of a screw hole 39 and a stepped screw 40. In the sheet conveying device of FIG. 6, the screw hole 39 is formed in the guide plate 9 in the vicinity of the support hole 36. When attaching the plate spring 32 to the guide plate 9, the other end part 32*a* and the stepped folded portion 33 of the plate spring 32 are inserted into the support hole 36 in the guide plate 9, and the through hole 38 in the plate spring 32 is aligned with the screw hole 39 in the guide plate 9. The stepped screw 40 that is subjected to a header process is inserted into the through hole 38 and is threaded into the screw hole 39. The height of a step portion 40*a* of the stepped screw 40 is set to be greater than the thickness of the plate spring 32 to prevent the plate spring 32 from being in intimate contact with the surface of the guide plate 9. That is, the plate spring 32 is spaced apart from the guide plate 9 via the step portion 40*a*. With this construction, the plate spring 32 is configured to be pivotable around the step portion 40*a* of the stepped screw 40 (i.e., around an axis line of the stepped screw 40).

In the sheet conveying device of FIG. 5, when the driven roller 31 is positioned adjacent to a heating member, for example, in a fixing roller, the protrusion 37 on the guide plate 9 may expand due to the heat that is radiated from the heating member. As a result, little clearance may be left between the protrusion 37 and the through hole 38, and the shape of the protrusion 37 may be changed due to the heat, thereby causing the plate spring 32 not to pivot around the protrusion 37 smoothly. However, in the sheet conveying device of FIG. 6, even when the driven roller 31 is positioned adjacent to the above-described heating member, the plate spring 32 can stably pivot around the step portion 40*a* of the stepped screw 40.

Figure 7A:
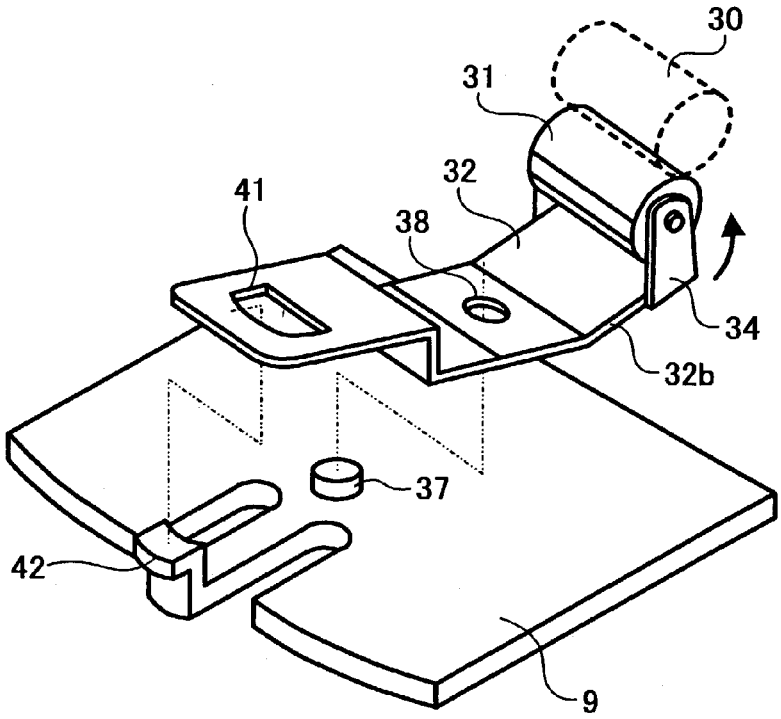
FIG. 7A is a perspective view of a sheet conveying device according to another embodiment of the present invention.
Figure 7B:
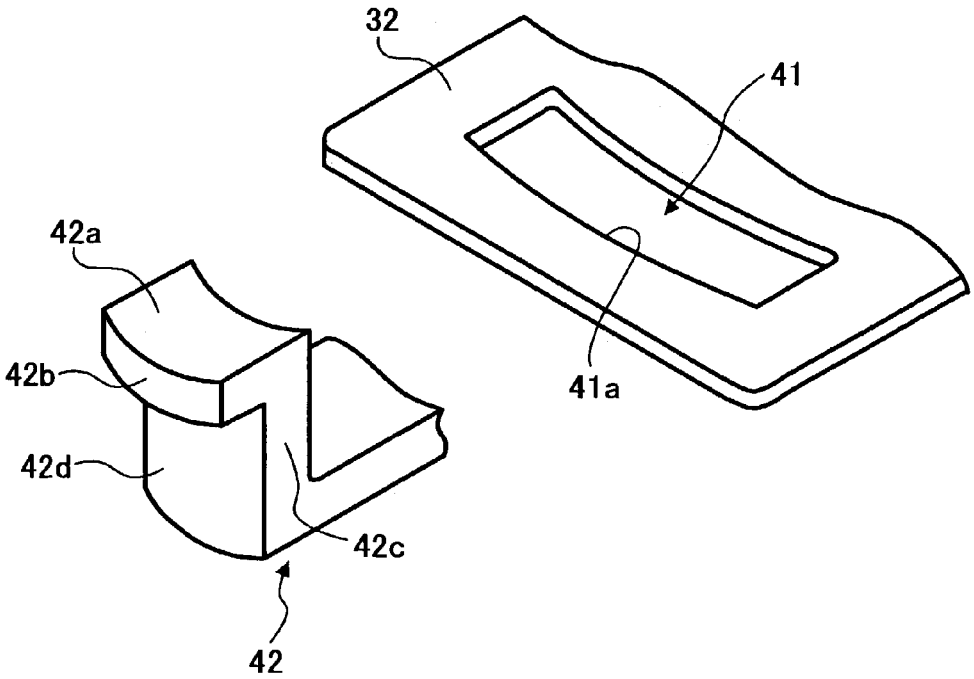
FIG. 7B is an enlarged perspective view of main parts of the sheet conveying device of FIG. 7A.
Figure 8:
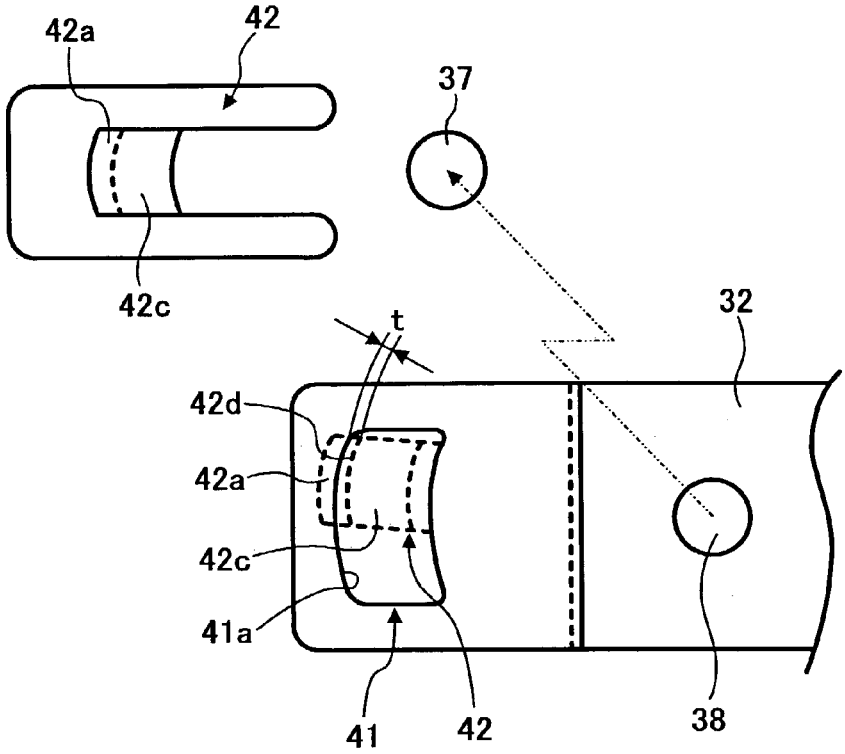
FIG. 8 is an exploded top view of main parts of the sheet conveying device of FIG. 7A.

FIG. 7A is a perspective view of a sheet conveying device according to another embodiment of the present invention, and FIG. 7B is an enlarged perspective view of main parts of the sheet conveying device of FIG. 7A. Further, FIG. 8 is an exploded top view of main parts of the sheet conveying device of FIG. 7A. The construction of the sheet conveying device of FIG. 7A is similar to that of the sheet conveying device of FIG. 5. In the sheet conveying device of FIG. 7A, the plate spring 32 further includes a hole 41 on the opposite side from the driven roller 31 to catch a support pawl 42 provided on the guide plate 9.

Specifically, when attaching the plate spring 32 to the guide plate 9, in addition to the fitting of the protrusion 37 on the guide plate 9 into the through hole 38, the support pawl 42 is inserted into the hole 41 and is caught by an edge portion 41*a* of the hole 41, thereby pressing the plate spring 32 toward the guide plate 9 by the support pawl 42. The hole 41 has an opening greater than the support pawl 42 so as not only to pass the support pawl 42 through the hole 41 but also to allow the plate spring 32 to move.

As illustrated in FIG. 7B and FIG. 8, the edge portion 41*a* of the hole 41 located on the side opposite to the driven roller 31 is in the shape of an arc concentric with the through hole 38. The edge portion 41*a* of the hole 41 is curved outward in a direction away from the through hole 38.

The support pawl 42 includes a tip end portion 42*a* and a base portion 42*c*. The tip end portion 42*a* includes a circumferential surface portion 42*b*, and the base portion 42*c* includes a side surface portion 42*d*. Each of the circumferential surface portion 42*b* and the side surface portion 42*d* is in the shape of an arc. Specifically, the side surface portion 42*d* is in the shape of an arc concentric with the edge portion 41*a* of the hole 41.

The distance between the center of the protrusion 37 on the guide plate 9 and the circumferential surface portion 42*b* of the tip end portion 42*a* of the support pawl 42 is set to be greater than the distance between the center of the through hole 38 in the plate spring 32 and the edge portion 41*a* of the hole 41. By this setting, when the plate spring 32 is attached to the guide plate 9 by fitting the protrusion 37 into the through hole 38 and by inserting the support pawl 42 into the hole 41 and by causing the support pawl 42 to be caught by the edge portion 41*a* of the hole 41, the lower surface of the tip end portion 42*a* of the support pawl 42 presses the plate spring 32 toward the guide plate 9.

Further, the distance between the center of the protrusion 37 on the guide plate 9 and the side surface portion 42*d* of the base portion 42*c* of the support pawl 42 is set to be less than the distance between the center of the through hole 38 in the plate spring 32 and the edge portion 41*a* of the hole 41. By this setting, when attaching the plate spring 32 to the guide plate 9, the tip end portion 42*a* can easily pass through the hole 41 just by pushing the base portion 42*c* a little toward the protrusion 37.

Therefore, when attaching the plate spring 32 to the guide plate 9, the center lines of the through hole 38 and hole 41 in the plate spring 32 do not have to be aligned with the center lines of the protrusion 37 and support pawl 42 on the guide plate 9, respectively. Specifically, even when the plate spring 32 is attached to the guide plate 9 such that the angle of the plate spring 32 relative to the guide plate 9 is deviated, the amount of the support pawl 42 that climbs over the edge portion 41*a* of the hole 41 and that is caught by the edge portion 41*a* becomes substantially equal regardless of whether there is a deviation in the above-described angle, because respective shapes of corresponding parts of the plate spring 32 to those of the guide plate 9 are a circle, a cylinder, and arcs. With this construction of the plate spring 32 and the guide plate 9, the plate spring 32 can be easily set on the guide plate 9.

Referring further to FIG. 8, even when the plate spring 32 pivots around the protrusion 37 after the plate spring 32 is set on the guide plate 9, a gap (t) between the edge portion 41*a* of the hole 41 in the plate spring 32 and the side surface portion 42*d* of the base portion 42*c* of the support pawl 42 is maintained. Therefore, the edge portion 41*a* of the hole 41 is in non-contact relation to the side surface portion 42*d*. As a result, even when the plate spring 32 pivots around the protrusion 37, the plate spring 32 is not under the load caused by the sliding contact of the edge portion 41*a* with the side surface portion 42*d*.

In the sheet conveying device of FIG. 7A, the side surface portion 42*d* of the base portion 42*c* of the support pawl 42 is in the shape of an arc concentric with the edge portion 41*a* of the hole 41. Further, as described above, the edge portion 41*a* of the hole 41 is in non-contact relation to the side surface portion 42*d* of the base portion 42*c*. However, the construction of the sheet conveying device, and each shape of the side surface portion 42*d* and the edge portion 41*a* is not limited to the above and may be changed so long as similar effects can be obtained. For example, the edge portion 41*a* of the hole 41 may be in point-contact or substantially point-contact with the side surface portion 42*d* of the base portion 42*c*. In this case, there is little increase of the load due to the contact resistance, so that the similar effects can be obtained as in the sheet conveying device of FIG. 7A. Further, the gap (t) between the edge portion 41*a* of the hole 41 and the side surface portion 42*d* of the base portion 42*c* of the support pawl 42 may not have to be kept constant so long as the edge portion 41*a* of the hole 41 can be maintained in point-contact or substantially point-contact with the side surface portion 42*d* of the base portion 42*c*.

Figure 9:
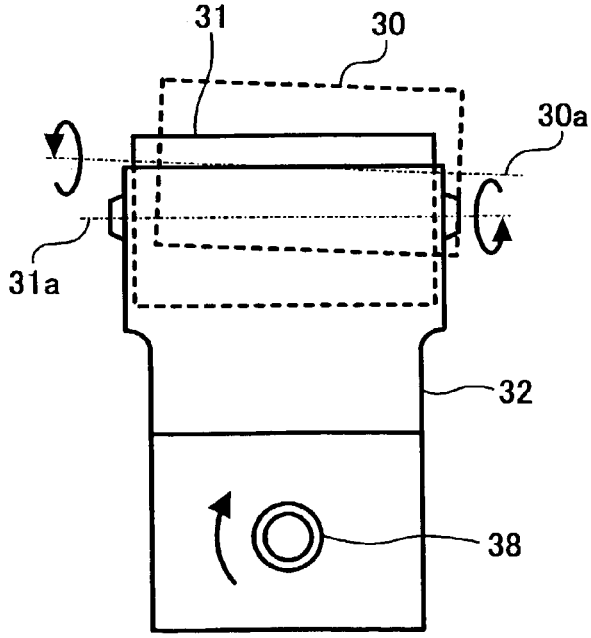
FIG. 9 is a schematic plan view for explaining the operation of the sheet conveying devices of FIGS. 5, 6, and 7A.

The operation of the sheet conveying devices of FIGS. 5, 6, and 7A will be described referring to FIG. 9. In the sheet conveying devices of FIGS. 5, 6, and 7A, to stably convey the sheet (S) to a predetermined position without occurrence of sheet skew, a shaft axis 30*a* of the drive roller 30 needs to be in parallel with a shaft axis 31*a* of the driven roller 31. Further, the drive roller 30 and the driven roller 31 need to be positioned so that the shaft axes 30*a* and 31*a* are perpendicular to the sheet conveying direction. However, when the plate spring 32 is attached to the guide plate 9 and is slanted, for example, leftward with respect to the shaft axis 30*a* of the drive roller 30 as illustrated in FIG. 9, the driven roller 31 supported by the plate spring 32 is press-contacted against the drive roller 30 such that the shaft axis 31*a* of the driven roller 31 is slanted leftward with respect to the shaft axis 30*a* of the drive roller 30 as illustrated in FIG. 9.

In this condition, when the driven roller 31 is rotated by the rotation of the drive roller 30, a rightward turning moment is produced in the plate spring 32 by the drive force generated by the drive roller 30 around the protrusion 37 fitted into the through hole 38 in the plate spring 32 or around the step portion 40*a* of the stepped screw 40. The turning moment becomes zero when the plate spring 32 pivots to the position in which the shaft axis 30*a* of the drive roller 30 and the shaft axis 31*a* of the driven roller 31 are parallel with each other. In the above-described sheet conveying devices, the guide plate 9 serving as a holding member is configured to pivotally hold the plate spring 32. Therefore, even when the shaft axis 31*a* of the driven roller 31 is slanted with respect to the shaft axis 30*a* of the drive roller 30 when the plate spring 32 is attached to the guide plate 9, the plate spring 32 pivots around the protrusion 37 or the axis line of the stepped screw 40 by the turning moment produced in the plate spring 32 by the drive force generated by the drive roller 30, and thereby the shaft axis 31*a* of the driven roller 31 can be kept in parallel with the shaft axis 30*a* of the drive roller 30 while the drive roller 30 is rotating.

In the sheet conveying devices in the image forming apparatus according to the present embodiments, the position of the shaft of the driven roller 31 can be properly aligned with the position of the shaft of the drive roller 30 by the turning moment produced in the plate spring 32 by the drive force generated by the drive roller 30 with a simple construction. Specifically, the shaft axis 31*a* of the driven roller 31 can be kept in parallel with the shaft axis 30*a* of the drive roller 30 while the drive roller 30 is rotating. As a result, the sheet (S) can be conveyed smoothly in a sheet conveying path in the image forming apparatus without occurrence of sheet skew, and thereby a quality image can be obtained in the image forming apparatus.

In the above-described embodiments, the plate spring 32 is used as a biasing member that rotatably supports the driven roller 31 and biases the driven roller 31 against the drive roller 30. The biasing member is not limited to the plate spring 32 and may be other members having a resilient property to cause the driven roller 31 to be press-contacted against the drive roller 30. Further, the plate spring 32 may rotatably support the drive roller 30 in place of the driven roller 31 to bias the drive roller 30 against the driven roller 31. In this case, the position of the shaft of the drive roller 30 may be properly aligned with the position of the shaft of the driven roller 31.

The present invention is applied to a sheet conveying device including a pair of sheet conveying rollers in an image forming apparatus that forms images on dual sides of a sheet. However, the present invention is not limited to the embodiments. For example, the present invention may be applied to a sheet conveying device for use in an image forming apparatus that forms an image on a single side of a sheet. Further, the present invention may be applied to any devices including a drive roller and a driven roller that is press-contacted against the drive roller in an image forming apparatus. For example, a pair of drive and driven rollers may include a fixing roller and a pressure roller in a heat fixing device that fixes a toner image onto the surface of a sheet, may include sheet discharging rollers in a sheet discharging device that discharges a sheet from an image forming apparatus, or may include sheet feeding rollers in a sheet feeding device that feeds sheets which are stacked in a sheet feeding cassette toward an image forming section. Moreover, the present invention may be applied to a conveyance device for use in an apparatus other than an image forming apparatus, which conveys a sheet or film shaped member.

Numerous additional modifications and variations of the present invention are possible in light of the above teachings. It is therefore to be understood that within the scope of the appended claims, the present invention may be practiced otherwise than as specifically described herein.

The invention claimed is:

1. A sheet conveying device comprising:

a drive roller including a shaft;

a driven roller including a shaft;

a biasing member configured to rotatably support one of the drive roller and the driven roller at a first end portion thereof and to bias one of the drive roller and the driven roller against the other one of the drive roller and the driven roller, a second end portion of the biasing member having an L shape cross section; and a holding member having a support hole and being configured to pivotally hold the biasing member, wherein the sheet conveying device conveys a sheet while rotating the drive roller and the driven roller and passing the sheet through a nip part formed between the drive roller and the driven roller, and the support hole of the holding member is configured to receive the second end portion of the biasing member, wherein a position of the shaft of the drive roller and a position of the shaft of the driven roller are aligned to be substantially parallel with each other by a turning moment produced in the biasing member by a drive force generated by the drive roller.

2. The sheet conveying device according to claim 1, wherein the biasing member includes a first hole, and the holding member includes a protrusion on a surface of the holding member, and wherein the biasing member is pivotally held by the holding member by fitting the protrusion into the first hole in the biasing member so that the biasing member pivots around the protrusion.

3. The sheet conveying device according to claim 1, wherein the biasing member includes a first hole, and the holding member includes a screw hole, and wherein the biasing member is pivotally held by the holding member by inserting a stepped screw into the first hole and by threading the stepped screw into the screw hole so that the biasing member pivots around an axis line of the stepped screw.

4. The sheet conveying device according to claim 3, wherein the stepped screw includes a step portion that has a greater height than a thickness of the biasing member, and the biasing member is spaced from the holding member via the step portion of the stepped screw.

5. A sheet conveying device, comprising:

a drive roller including a shaft;

a driven roller including a shaft;

a biasing member configured to rotatably support one of the drive roller and the driven roller and to bias one of the drive roller and the driven roller against the other one of the drive roller and the driven roller; and and a holding member configured to pivotally hold the biasing member, wherein the sheet conveying device conveys a sheet while rotating the drive roller and the driven roller and passing the sheet through a nip part formed between the drive roller and the driven roller, the biasing member includes a first hole, the holding member includes a protrusion on a surface of the holding member, the biasing member is pivotally held by the holding member by fitting the protrusion into the first hole in the biasing member so that the biasing member pivots around the protrusion, the biasing member rotatably supports one of the drive roller and the driven roller at one end part of the biasing member, the biasing member further includes a second hole including an edge portion at the other end part of the biasing member and on the opposite side from one of the drive roller and the driven roller, the holding member further includes a pawl portion, and the biasing member is pivotally held by the holding member by fitting the protrusion into the first hole in the biasing member and by causing the pawl portion to be caught by the edge portion of the second hole.

6. The sheet conveying device according to claim 5, wherein the edge portion of the second hole has an arc shape and is curved outward in a direction away from the first hole, and wherein a part of the pawl portion, which faces the edge portion of the second hole when the pawl portion is caught by the edge portion of the second hole, is one of in non-contact, in point-contact, and in substantially point-contact with the edge portion of the second hole.

7. The sheet conveying device according to claim 1, wherein the biasing member is configured to rotatably support the driven roller and to bias the driven roller against the drive roller.

8. The sheet conveying device according to claim 1, wherein the biasing member includes a plate spring.

9. An image forming apparatus, comprising:

an image carrier configured to carry an image; and a sheet conveying device configured to convey a sheet that receives the image on at least one side of the sheet, said sheet conveying device including, a drive roller including a shaft, a driven roller including a shaft, a biasing member configured to rotatably support one of the drive roller and the driven roller at a first end portion thereof and to bias one of the drive roller and the driven roller against the other one of the drive roller and the driven roller, a second end portion of the biasing member having an L shaped cross section, and a holding member having a support hole and being configured to pivotally hold the biasing member, wherein the sheet conveying device conveys a sheet while rotating the drive roller and the driven roller and passing the sheet through a nip part formed between the drive roller and the driven roller, and the support hole of the holding member is configured to receive the second end portion of the biasing member, wherein a position of the shaft of the drive roller and a position of the shaft of the driven roller are aligned to be substantially parallel with each other by a turning moment produced in the biasing member by a drive force generated by the drive roller.

10. The image forming apparatus according to claim 9, wherein the biasing member includes a first hole, and the holding member includes a protrusion on a surface of the holding member, and wherein the biasing member is pivotally held by the holding member by fitting the protrusion into the first hole in the biasing member so that the biasing member pivots around the protrusion.

11. The image forming apparatus according to claim 9, wherein the biasing member includes a first hole, and the holding member includes a screw hole, and wherein the biasing member is pivotally held by the holding member by inserting a stepped screw into the first hole and by threading the stepped screw into the screw hole so that the biasing member pivots around an axis line of the stepped screw.

12. The image forming apparatus according to claim 11, wherein the stepped screw includes a step portion that has a greater height than a thickness of the biasing member, and the biasing member is spaced from the holding member via the step portion of the stepped screw.

13. The image forming apparatus according to claim 9, wherein the biasing member is configured to rotatably support the driven roller and to bias the driven roller against the drive roller.

14. The image forming apparatus according to claim 9, wherein the biasing member includes a plate spring.

15. An image forming apparatus, comprising:

an image carrier configured to carry an image; and a sheet conveying device configured to convey a sheet that receives the image on at least one side of the sheet, said sheet conveying device including, a drive roller including a shaft, a driven roller including a shaft, a biasing member configured to rotatably support one of the drive roller and the driven roller and to bias one of the drive roller and the driven roller against the other one of the drive roller and the driven roller, and a holding member configured to pivotally hold the biasing member, wherein the sheet conveying device conveys a sheet while rotating the drive roller and the driven roller and passing the sheet through a nip part formed between the drive roller and the driven roller, the biasing member includes a first hole, the holding member includes a protrusion on a surface of the holding member, the biasing member is pivotally held by the holding member by fitting the protrusion into the first hole in the biasing member so that the biasing member pivots around the protrusion, the biasing member rotatably supports one of the drive roller and the driven roller at one end part of the biasing member, the biasing member further includes a second hole including an edge portion at the other end part of the biasing member and on the opposite side from one of the drive roller and the driven roller, the holding member further includes a pawl portion, and the biasing member is pivotally held by the holding member by fitting the protrusion into the first hole in the biasing member and by causing the pawl portion to be caught by the edge portion of the second hole.

16. The image forming apparatus according to claim 15, wherein the edge portion of the second hole has an arc shape and is curved outward in a direction away from the first hole, and wherein a part of the pawl portion, which faces the edge portion of the second hole when the pawl portion is caught by the edge portion of the second hole, is one of in non-contact, in point-contact, and in substantially point-contact with the edge portion of the second hole.

* * * * *